US006779322B2

(12) United States Patent
Barnes

(10) Patent No.: US 6,779,322 B2
(45) Date of Patent: Aug. 24, 2004

(54) SAFETY STIRRUP

(76) Inventor: Maurice Barnes, Miles Cross, Symondsbury, Bridport, Dorset (GB), DT6 6HE ( * ) Notice: Subject to any disclaimer, the term of this patent is extended or adjusted under 35 U.S.C. 154(b) by 0 days.

(21) Appl. No.: 10/398,970

(22) PCT Filed: Oct. 29, 2001

(86) PCT No.: PCT/GB01/04779

§ 371 (c)(1),
(2), (4) Date: Apr. 11, 2003

(87) PCT Pub. No.: WO02/36483

PCT Pub. Date: May 10, 2002

(65) Prior Publication Data

US 2004/0011009 A1 Jan. 22, 2004

(51) Int. Cl.[7] ..... B68C 3/00
(52) U.S. Cl. ..... 54/49; D30/142
(58) Field of Search ..... 54/47, 48, 49; D30/142

(56) References Cited

U.S. PATENT DOCUMENTS

| | | | | | |
|---|---|---|---|---|---|
| 4,373,321 | A | * | 2/1983 | Prendergast | 54/49 |
| 4,680,921 | A | * | 7/1987 | Bezin | 54/49 |
| D417,038 | S | * | 11/1999 | Bostock | D30/142 |
| 6,282,872 | B1 | * | 9/2001 | Schulte | 54/49 |
| 6,698,169 | B1 | * | 3/2004 | Bostock | 54/49 |

FOREIGN PATENT DOCUMENTS

| | | | | | |
|---|---|---|---|---|---|
| GB | 2085272 | A | * | 4/1982 | B68C/3/00 |

* cited by examiner

*Primary Examiner*—Charles T. Jordan
(74) *Attorney, Agent, or Firm*—Ira S. Dorman

(57) ABSTRACT

A riding stirrup includes a foot-receiving part 1 and a plate-like part 2 which is suspended from a strap 14. The part 1 is pivotally received on a tongue 7 held by a flange 8 and a retaining plate 9 which is secured to the plate 2 by snap fasteners 11. Normal downward forces on the stirrup do not dislodge the plate 9, but if the rider falls from the saddle the part 1 pivots in direction A levering the fasteners 11 apart. The retaining plate 9 is thus freed allowing the foot-retaining part 1 to separate from the suspension part 2.

8 Claims, 1 Drawing Sheet

SAFETY STIRRUP

TECHNICAL FIELD OF THE INVENTION

This invention relates to stirrups as used in horse riding.

BACKGROUND

Many injuries which occur when a rider falls from a horse are due to the fact the riders foot becomes caught in the stirrup so that there is a high risk of serious injury as the rider is dragged along.

The present invention seeks to provide a new and inventive form of stirrup.

SUMMARY OF THE INVENTION

The present invention proposes a riding stirrup which has a foot-receiving part and a suspension part for connection with a strap, in which the foot-receiving part is pivotally received on a projection on the suspension part to pivot about an axis which is generally parallel to the plane of the foot-receiving part and is held thereon by a retaining member which is released from the suspension part by such pivotal movement of the foot-receiving part.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
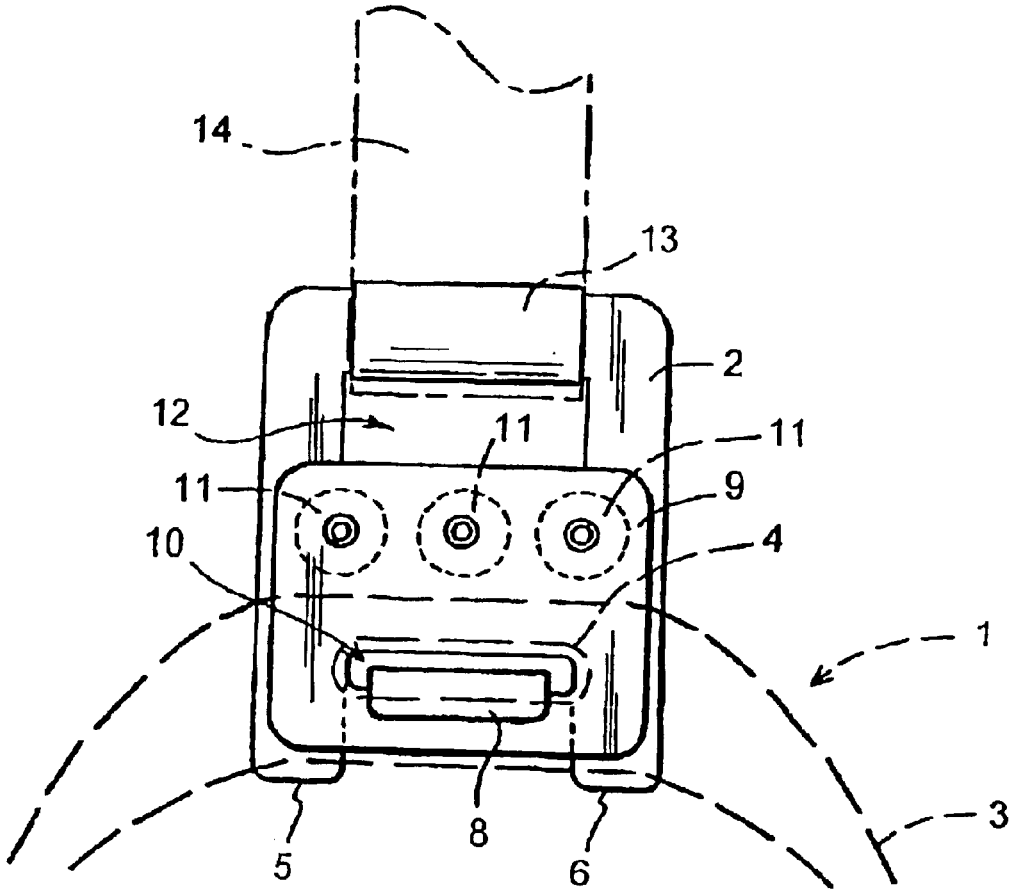
FIG. 1 is a front view of part of a riding stirrup in accordance with the invention.
Figure 2:
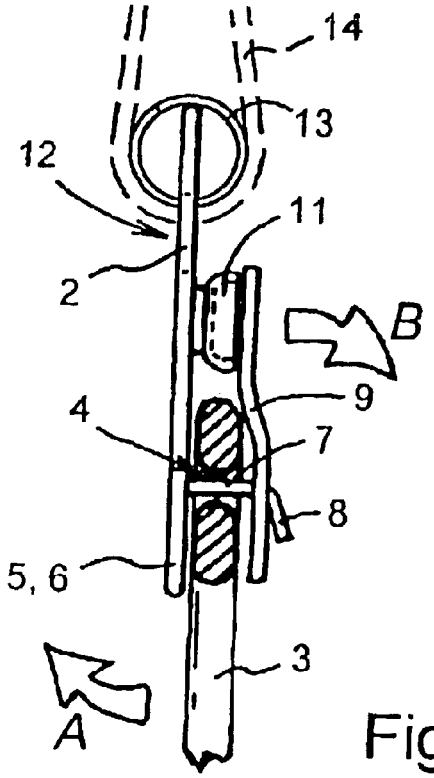
FIG. 2 is a side view looking from the left in FIG. 1 with the stirrup shown partly in section.

Referring to the drawings, the stirrup has a main foot-receiving stirrup part 1 (shown in outline only) which is suspended below a suspension part 2.

The main stirrup part 1 is of conventional form having a hoop 3 with a elongate planar tread (not shown) which may be formed as a solid flat plate, an apertured plate or a framework. A slot 4 is formed at the top of the hoop 3, which is intended to receive a strap for suspending the stirrup.

The suspension part 2 is stamped from metal plate and is generally flat with a pair of spaced downwardly projecting fingers 5 and 6. Between these fingers a flat tongue 7 is bent perpendicularly to receive the slot 4 of the main part 1, held by a depending flange 8. A retaining member 9, also formed of flat plate, is placed over the tongue 7 which is received in a slot 10. The flange 8 assists in holding the retaining member on the tongue 7 but the retaining member is also held to the suspension part 2 by two or three snap-fit studs

11 arranged in a row above the tongue 7 and each having a female part attached to the part 2 and a male part on the member 9. A suspension eye 12 is formed at the top of the part 2 by stamping a rectangular hole in the plate to receive a suspension strap 14. A split cylindrical member 13 is rotatably inserted through the eye 12 to cover the top margin of the eye 12 and thus reduce wear on the strap 14.

In normal use the rider normally exerts a generally downward force on the stirrup part 1 so that the parts are unable to become detached, even with considerable jerking or twisting of the stirrup about a vertical axis. However, if the rider falls from the saddle the stirrup part 1 pivots on the tongue 7 in the direction of the arrow A and creates a levering action between the fingers 5, 6 and the retaining member 9 causing the studs 11 to snap apart. This allows the retaining member 9 and stirrup 1 to rotate off the projecting tongue 7 in the direction of arrow B, which thus releases the stirrup and hence the rider.

It will be appreciated that the features disclosed herein may be present in any feasible combination. Whilst the above description lays emphasis on those areas which, in combination, are believed to be new, protection is claimed for any inventive combination of the features disclosed herein.

What is claimed is:

1. A riding stirrup which has a foot-receiving part (1) and a suspension part (2) for connection with a strap, in which the foot-receiving part is pivotally received on a projection (7) on the suspension part to pivot about an axis which is generally parallel to the plane of the foot-receiving part and is held thereon by a retaining member (9) which is released from the suspension part by such pivotal movement of the foot-receiving part.

2. A riding stirrup according to claim 1, in which the projection on the suspension part consists of or includes a planar tongue (7).

3. A riding stirrup according to claim 2, in which the planar tongue (7) has a depending flange (8).

4. A riding stirrup according to claim 2, in which the retaining member (9) is generally planar with a slot (10) for receiving the tongue (7).

5. A riding stirrup according to claim 1, in which the retaining member (9) is snap-engaged with the suspension part (2).

6. A riding stirrup according to claim 1, in which the retaining member (9) is releasably connected with the suspension part (1) by at least one snap fastener (11) disposed to one side of the projection (7).

7. A riding stirrup according to claim 1, in which the suspension part (2) has a suspension eye (12) for receiving a strap by which said part is suspended.

8. A riding stirrup according to claim 1, in which the suspension part (1) is generally planar.

* * * * *